United States Patent [19]

Miller

[11] Patent Number: 4,787,288

[45] Date of Patent: Nov. 29, 1988

[54] RAPID FIRE TRIGGER ACTIVATOR

[76] Inventor: Clifford E. Miller, 3605 Elizabeth, Melvindale, Mich. 48123

[21] Appl. No.: 77,653

[22] Filed: Jul. 24, 1987

[51] Int. Cl.[4] ..... F41F 13/04

[52] U.S. Cl. ..... 89/27.3; 89/136

[58] Field of Search ..... 89/140, 142, 27.3, 128, 89/136; 42/69.01

[56] References Cited

U.S. PATENT DOCUMENTS

| | | | |
|---|---|---|---|
| 1,485,717 | 3/1924 | Russell et al. | 89/136 |
| 2,186,969 | 1/1940 | Green | 89/136 |
| 2,298,013 | 10/1942 | Joyce | 89/142 |
| 2,367,280 | 1/1945 | Hyde | 89/140 |
| 2,370,835 | 3/1945 | Bell et al. | 89/142 |
| 2,407,157 | 9/1946 | Hyde | 89/140 |
| 2,967,367 | 1/1961 | Ivy | 89/140 |
| 2,978,962 | 4/1961 | Ivy | 89/140 |
| 3,240,122 | 3/1966 | Bolles | 89/140 |
| 3,618,455 | 11/1971 | Plumer et al. | 89/140 |
| 3,626,805 | 12/1971 | Shiplee | 89/128 |
| 3,785,243 | 1/1974 | Christakes | 89/142 |

*Primary Examiner*—Harold J. Tudor
*Assistant Examiner*—Stephen Johnson
*Attorney, Agent, or Firm*—Joseph J. Goluban

[57] ABSTRACT

A Rapid Fire Trigger Activator and accessory gun stock used to convert any semi-automatic carbine, rifle, or shot gun to nearly the firing capability of an automatic weapon which includes, a main side plate, having a pivot pin; a slide tube; a fore end hand grip; a slotted cam plate; a transfer bar; a swing out safety block; a trigger activator having a spring load plunger pin; and a nylon bearing block. When the fore end hand grip is pumped back and forth it will cause the transfer bar to pivot about the pivot pin which in turn will cause the trigger activator to be displaced towards the weapons trigger by the swing out safety block due to the up and down displacement of a transfer bar slot pin as it follows the cam slot. The trigger of the weapon is always fully accessible and functional whether or not the safety block is in place or not. The swing of the safety block is fitted with a spring loaded plunger pin that allows for its adjustment to various types of weapon trigger configurations and different types of weapon sear actions. On the forward portion of the main side plate is a nylon bearing block which has a frictional slide lock which functions as an additional safety feature to prevent the unintentional movement of the slotted cam plate due to the accidental displacement of the fore end hand grip.

20 Claims, 4 Drawing Sheets

RAPID FIRE TRIGGER ACTIVATOR

BACKGROUND OF THE INVENTION

1. Field of the Invention

The invention relates in general to a rapid fire trigger activator and accessory gun stock used to convert semi-automatic carbines, rifles, or shotguns to nearly the firing capability of an automatic weapon.

Two prototypes of the invention which are disclosed basically have identical operation features, except for reversing of the cam plate required on some models of carbines, rifles, or shotguns due to the differences in the receiver shape which require additional clearance space to operate.

The inventor's preferred embodiment is designed to be readily adapted to fire arms, such as, a Ruger TM 10-22 carbine. Since the Ruger TM 10-22 carbine has a one piece stock a pistol grip and adjustable shoulder stock are required as part of the apparatus used to convert it. The conversion of fire arms, such as, the Ruger TM 10-22 or Charter Arm AR 7 can be easily accomplished by simply replacing the original stock with the invention which utilizes only the existing stock mounting pins and screws and the barrel of the carbine. However, on semi-automatic weapons having a two piece stock the rear pistol grip and shoulder stock would be omitted and the invention would be directly attached to the weapons receiver by means of the existing mounting pins and screws.

2. Description of Prior Art

The applicant is aware of the below described types of trigger activators used to increase the firing speed of a semi-automatic weapon but in all of these devices the semi-automatic firing ability is lost due to the weapon's trigger no longer being accessible by the user. The first type of rapid fire trigger activator that the applicant wishes to disclose is a BMF crank type apparatus which makes the gun useless as a semi-automatic weapon. The BMF activator mounts on the inside trigger guide by a thumb screws and is operated by means of a crank which rotates a shaft having lobes on it which causes the weapons trigger to be displaced. The BMF device is difficult to operate since one hand is required to crank it, therefore, it cannot be operated in a conventional manner.

The second type of rapid fire trigger activator that the applicant is aware of is of a machine gun style and is mounted on a tripod having two semi-automatic weapons mounted back to back. A rocker bar with a pin is connected to each trigger of the weapon and operates much like a Gatling gun when the crank is turned.

The third type of rapid fire trigger activator that the applicant has only seen pictures of, appears to be strapped to the pistol grip of a Ruger TM 10-22 carbine and completely covers the weapons trigger. The device has a grease gun type handle which when squeezed operates some kind of ratch device that activates the weapons trigger. Both the second and third devices have the same operational limitations of the BMF device viz.; the semi-automatic operation of the weapon is lost since the weapons trigger is not accessible.

Applicant's invention is far superior to all of the above disclosed devices since it operates in a normal two handed manner which allows it to be fired more accurately from either the shoulder or hip positions, thus making it far superior in both design and function. Further applicant's invention can be easily attached to any type of semi-automatic weapon whether it has a one or two piece stock by using conventional mounting pins or screws without altering in any way the weapons action.

SUMMARY OF THE INVENTION

In accordance with the present invention, I have invented a Rapid Fire Trigger Activator with accessory gun stock used to convert any semi-automatic carbine, rifle, or shotgun into a weapon having nearly the same firing capability as an automatic weapon.

Another object of the present invention is to provide an inexpensive means for converting a semi-automatic Ruger TM 10-22 carbine into a weapon having nearly the same firing capability as an automatic weapon.

Another object of the present invention is to provide an inexpensive means for converting a semi-automatic Charter Arm AR 7 carbine into a weapon having nearly the same firing capability as an automatic weapon.

Another object of the present invention is to provide a Rapid Fire Trigger Activator conversion device for semi-automatic carbines, rifles, or shotguns which requires little or no maintenance.

Still another object of the present invention is to provide a Rapid Fire Trigger Activator which can be easily installed in the field to any semi-automatic weapon by the average user without any special training.

Still another object of the present invention is to provide an improved device for modifying an existing semi-automatic weapon into a rapid firing weapon of near automatic capability, without the loss of the semi-automatic operating feature.

Still another object of the present invention is to provide a means for converting a semi-automatic weapon into nearly an automatic weapon without replacing any of the weapons action.

A still further object of the present invention is to provide a Rapid Firing Trigger Activator that allows any semi-automatic weapon to be fired in a conventional manner.

A still further object of the present invention is to provide a Rapid Firing Trigger Activator that can be operated like a conventional pump action weapon when attached to a semi-automatic carbine, rifle, or shotgun.

A still further object of the present invention is to provide a Rapid Firing Trigger Activator that is inexpensive to manufacture and easily adaptable to any type of semi-automatic carbine, rifle, or shotgun.

A further object of the present invention is to provide a Rapid Firing Trigger Activator that can be operated in either a semi-automatic or rapid fire mode without the necessity of removing the attachment from the weapons trigger.

A further object of the present invention is to provide an improved Rapid Firing Trigger Activator that has a swing out safety block which when not in place prohibits the weapon from being accidently operated in the rapid fire mode.

A further object of the present invention is to provide an improved Rapid Firing Trigger Activator which has a trigger activator and a transfer bar which are mounted to a pivot pin.

Further object and advantages of this invention will be apparent from the following description and appended claims, reference being made to the accompanying drawings forming a part of this specification, wherein like reference characters designate corresponding parts in the several views.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

It is to be understood that the present invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description and not of limitation.

DETAILED DESCRIPTION OF THE PREFERRED EMBODIMENT OF THE INVENTION

Figure 1:
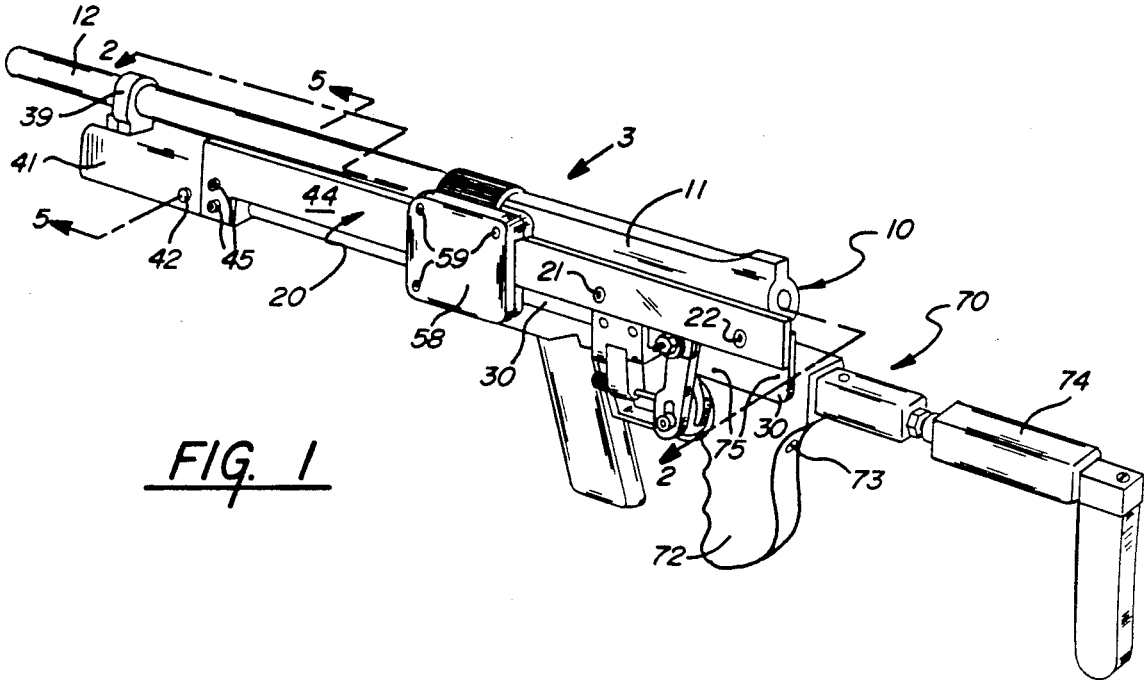
FIG. 1 is a perspective view of my Rapid Fire Trigger Activator and gun stock accessory attached to a semi-automatic weapon.

Referring to FIG. 1 which is a perspective view of a Rapid Fire Trigger Activator generally designated by reference numeral 20 is shown as attached to a semi-automatic weapon 10. My Rapid Fire Trigger Activator 20, is attached to a semi-automatic weapon 10 having a straight sided receiver which allows the main side plate 30 to directly attached to the receiver of a semi-automatic weapon 10, such as a Charter Arm AR 7, by means of a single mounting screw 21 through an aperture in the side plate 30. As can be readily seen, after the single piece gun stock (not shown) of the semi-automatic weapon 10 is removed the attachment of my invention can be easily accomplished without the need to alter the action of the weapon in any manner. Once the main side plate 30 is attached to the weapon's receiver 11 it is only necessary to secure the gun stock accessory, generally designated by reference numeral 70 through an aperture located in the pistol grip 72 by means of grip screw 73.

Figure 4:
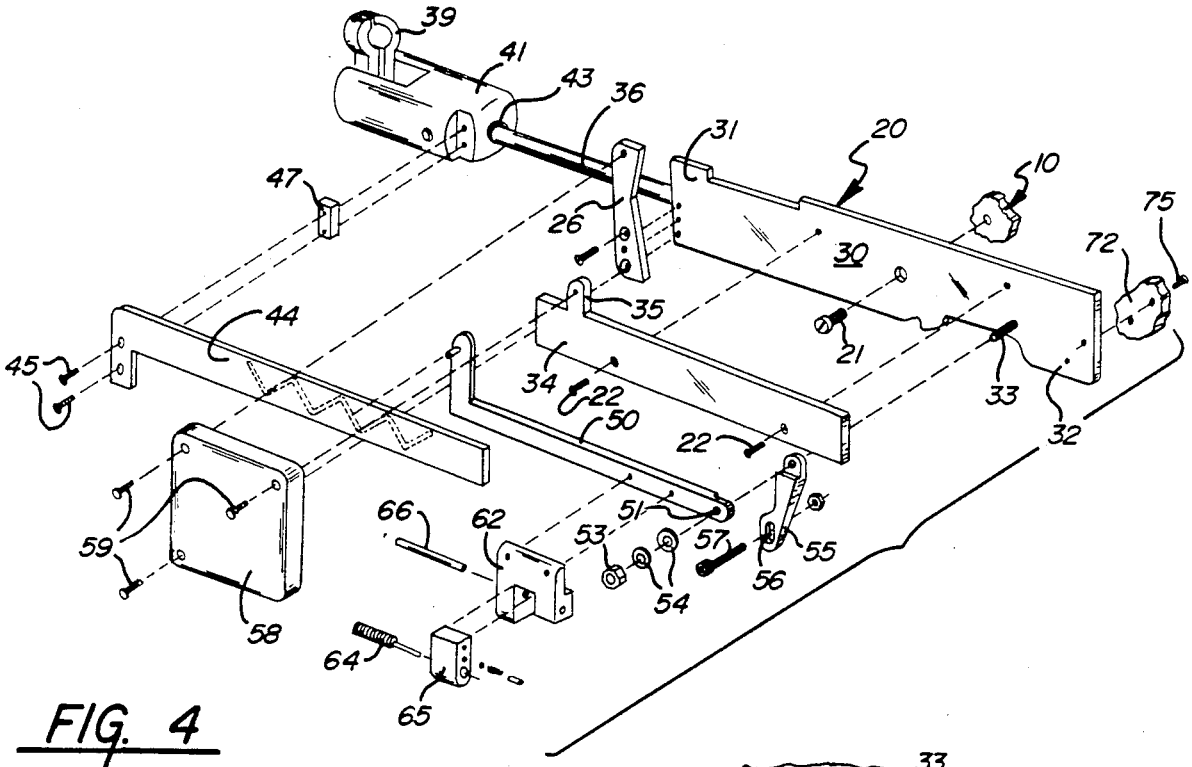
FIG. 4 is an exploded perspective view of my invention showing all Rapid Fire Trigger Activator elements without the pistol grip or adjustable shoulder stock.

The main side plate 30 has a fore end portion 31 and a rear portion 32 with a pivot pin 33 located near its rear portion 32, as can be best seen in FIG. 4 which is an exploded perspective view of my invention without the pistol grip 72 or the adjustable shoulder stock 74 being visible. To the top portion of the main side plate 30 is attached, by means of machine screws 22, a horizontal spacer 34 which is required due to the additional space needed to clear the receiver 11 to operate the Rapid Fire Trigger Activator 20 mechanism. The spacer 34 has a stem 35 at its top which is used to secure the completed apparatus assembly. While at the inside of the fore end portion 31 of the main side plate 30 is attached a vertical spacer 26, which functions as both a spacer and an anchor base for the nylon bearing block 58 once assembled.

Figure 2:
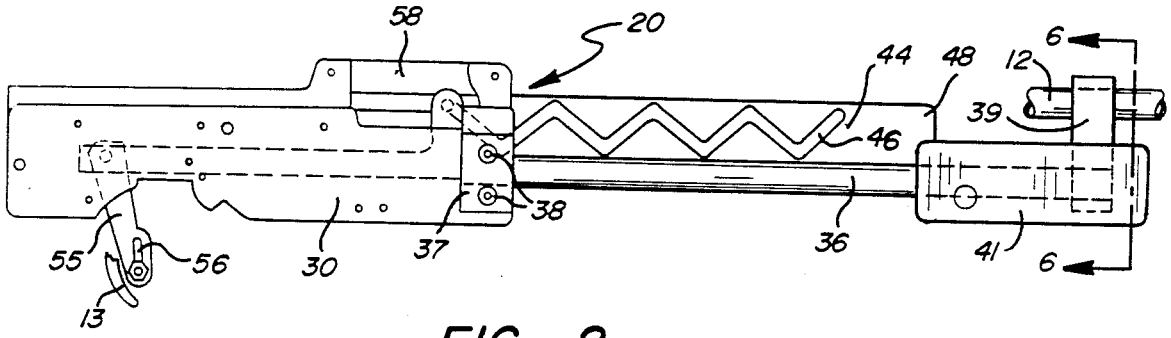
FIG. 2 is an elevational view taken in the direction of arrows 2—2 of FIG. 1 showing my Rapid Firing Trigger Activator as it would appear attached to a semi-automatic weapon with only a portion of the weapons gun barrel and trigger being visible.

A slide tube 36 is attached at one end to the fore end portion 31 of the main side plate 30 by means of an anchor block 37 and machine screws 38 with the opposite end of the slide tube 36 being securely mounted to the gun barrel 12 of the semi-automatic weapon 10 by means of a frictional barrel clamp 39 as can be best seen in FIG. 2 of the drawings, which is an elevational view taken in the direction of arrows 2—2 of FIG. 1 showing the Rapid Fire Trigger Activator 20 as it would appear attached to a semi-automatic weapon 10 with only the gun barrel 12 and trigger 13 being visible.

Figure 3:
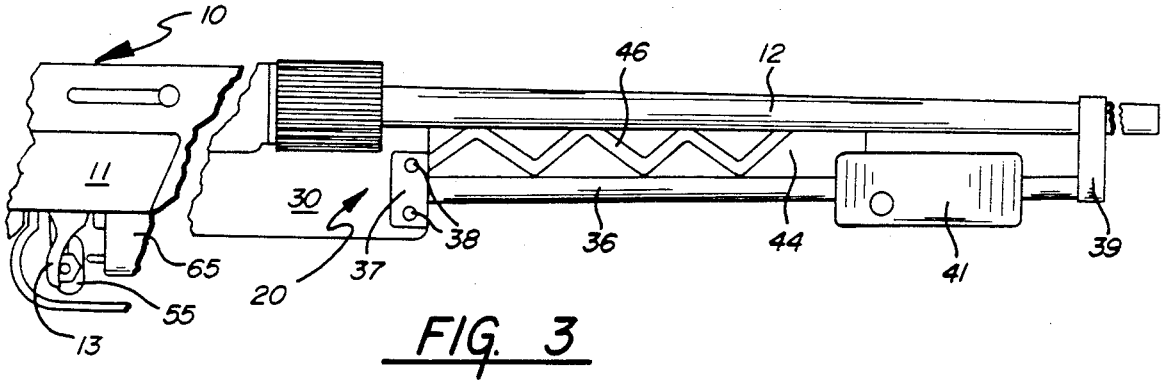
FIG. 3 is a fragmentary elevational view taken in the direction of arrow 3 of FIG. 1 showing my invention attached to a semi-automatic weapon with the receiver of the weapon visible.
Figure 5:
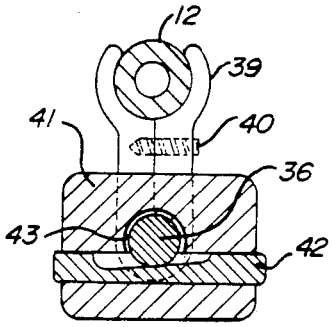
FIG. 5 is a cross section view taken along line 5—5 of FIG. 1 showing a wedge type frictional safety lock located in the fore end hand grip.
Figure 6:
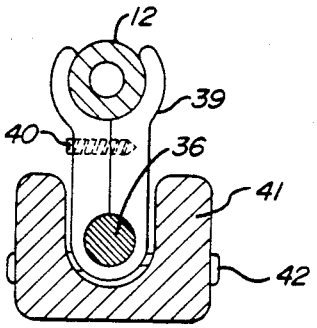
FIG. 6 is a cross section view taken along line 6—6 of FIG. 2 showing the end of the fore end hand grip.

A fore end hand grip 41 is mounted over the slide tube 36, as can be best seen in FIGS. 3, 5 and 6, through aperture 43 so as to allows its longitudinal displacement along the side tube 36. A slotted cam plate (inside) 44 is attached by means of machine screws 45 to the fore end hand grip 41 so that a longitudinal displacement of the fore end hand grip 41 will cause a like displacement of the slotted cam plate (inside) 44 as the hand grip 41 is moved back and forth in a pumping action. The slotted cam plate 44 has a v-shaped cam recess 46 and a fore end portion 48. A transfer bar 50 having an aperture 51 at one end and a cam follower slot pin 52 at the opposite end is pivotly mounted on the pivot pin 33 through aperture 51, over the trigger activator 55. The cam follower 52 located at the front end of the transfer bar 50 is designed to fit into the cam recess 46 of the slotted cam plate 44. The complete apparatus assembly is held in place by a nylon bearing block 58 which is attached by means of machine screws 59 secured into the vertical spacer 26 and horizontal spacer 34 stem 35. Another function of the nylon bearing block 58 which is located at the fore end portion 31 of the main side plate 30 is to provide a bearing surface for the slotted cam plate (inside) 44 and the transfer bar 50 as the cam plate 44 moves in a horizontal back and forth direction, while the transfer bar moves in an up and down direction as the fore end hand grip 41 moves back and forth along the slide tube 36, thus insuring for a smooth and uniform operation of the Rapid Fire Trigger Activator 20.

Figure 7:
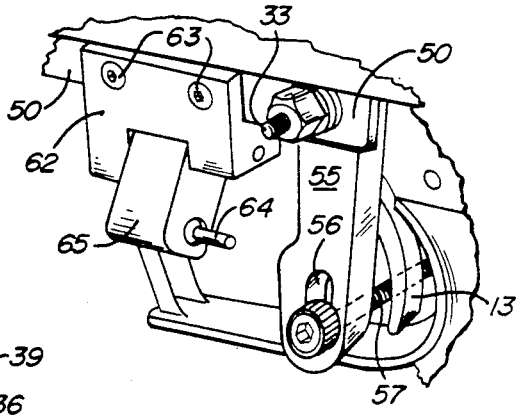
FIG. 7 is an enlarged perspective view of the swing out safety block and trigger activator in relationship to the semi-automatic weapons trigger.

A swing out safety block 62 is attached to the transfer bar 50 near the aperture 51 by means of machine screws 63 as can be best seen in FIG. 7 of the drawings which is an enlarged perspective view of the semi-automatic weapons 10 trigger 13 showing the swing 65 of the safety block 62 in an inactive position. The swing out safety block 62 functions as a safety switch when attached to the transfer bar 50 by not allowing the pivoting action of the transfer bar 50 to be transmitted to the trigger activator 55. As can be seen from the drawing the weapons trigger 13 is always fully accessible and functional, unlike the prior art, whether or not the swing 65 of the safety block 62 is in an active or inactive position.

In this my preferred embodiment of my invention the swing 65 out safety block 62 is fitted with a spring loaded plunger pin 64 which is disposed within the swing 65 portion of said safety block 62. As can be seen by reference to FIG. 4, the swing 65 of the swing out safety block 62 is pivotly connected by means of pin 66 to said block 62. When the swing 65 is swung out to the inactive position the trigger 13 cannot be operated by the trigger activator 55 of the Rapid Trigger Activator 20. However, the semi-automatic weapon 10 can still be fired semi-automatically or alternated between the semi-automatic or rapid fire mode.

It is important that the trigger activator 55 be mounted on the pivot pin 33 of the main side plate 30 independently from the transfer bar 50, otherwise, it would not be possible to operate the semi-automatic weapon 10 in a semi-automatic mode with the Rapid Fire Trigger Activator 20 apparatus. As can be seen by reference to FIGS. 4 and 7 the trigger activator 55 is mounted on the pivot pin 33 before the transfer bar 50 is secured in place by means of nut 53 and washers 54. The trigger activator 55 has a slot 56 which allows the vertical movement of trigger pin 57 to allow for less or more travel distance between the trigger pin 57 and the trigger 13 to allow the fine adjustment for different semi-automatic weapon 10, trigger 13 shapes. However, if you were manufacturing my invention for a specific brand of semi-automatic weapon 10 you could design the adjustable trigger activator 13 to fit said models trigger action and shape and eliminate the slot 56.

In this preferred embodiment I have disclosed the use of a spring loaded plunger pin 64 which allows it to be adjusted for various trigger 13 configurations and different types of weapon sear actions.

In many semi-automatic weapons 10, such as the Charter Arms AR-7, there has to be a slight trigger 13 movement to get the sear of the weapon to lock back up again. The sear being the latch that holds the hammer of the weapon, if a solid plunger pin was used, it would not allow for the slight forward movement of the weapons trigger 13 to allow the sear to lock up again before firing of the weapon can resume as is the case when the trigger is controlled by the operators finger, instead of the metal to metal contact which has no give. In other models of semi-automatic weapons 10 having a spring loaded sear the weapons trigger does not have to move to lock the sear and therefore the spring loaded plunger pin 64 could be replaced with a plunger pin having no spring.

Figure 8:
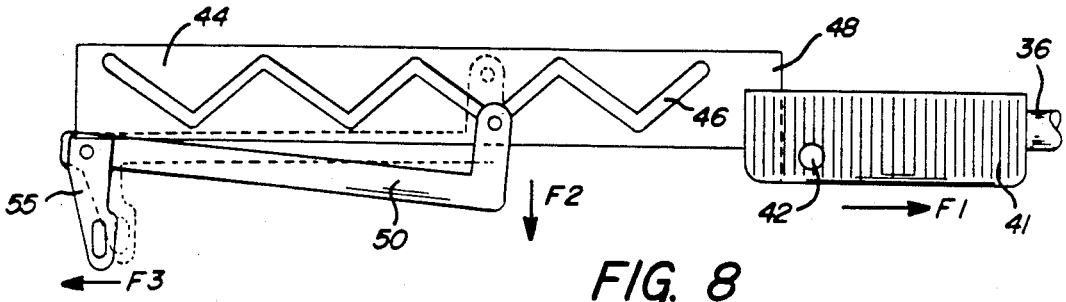
FIG. 8 is an enlarged elevational view of my device depicting the movement of the transfer bar and a trigger activator, as if the swing out safety block were in place.

Referring now to FIG. 8 of the drawings which is an enlarged elevational view of my Rapid Fire Trigger Activator 20 depicting the movement of the fore end hand grip 41 and slotted cam plate (inside) 44 in a horizontal direction of F-1 causing the movement of the transfer bar 50 cam follower slot pin 52 in a descending vertical direction of F-2 and horizontal movement of the trigger activator 55 in the F-3 direction caused by the plunger pin 64 of the swing out safety block 62 (not shown).

It can be appreciated that the use of a four lobe slotted cam plate (inside) 44 will allow the firing of the semi-automatic weapon 10 at nearly the firing capability of an automatic weapon, since each stroke of the fore end hand grip 41 will cause the discharge of four shots, giving the user a rate of fire of nearly five hundred rounds per minute. While applicant has found that the shape of the cam recess 46 is not critical, the v-shaped cam recess 46 is preferred with 3 to 4 fires per length of stroke of the fore end hand grip 41 which has proven in tests to be the most smooth in operation.

Applicant has disclosed as his preferred embodiment the use of a gun stock assembly 70 consisting of a pistol grip 72 and adjustable shoulder stock 74 which is mounted to the main side plate 30 by means of machine screws 75 as best seen in FIGS. 1 and 4 of the drawings which is required for semi-automatic weapons 10 having a one piece stock. On semi-automatic weapon 10 with a two piece stock both the pistol grip 72 and adjustable shoulder stock 74 would be eliminated.

Referring to FIG. 5 of the drawings I would now like to disclose a safety feature of my Rapid Fire Trigger Activator 20 which utilizes a frictional safety wedge 42 type mechanism which locks the fore end hand grip 41 in any position along the slide tube 36 to accommodate the users individual preference. It is necessary to prevent the unintentional movement of the slotted cam plate (44) which is an extension of the weapon's trigger 13 and would cause the semi-automatic weapon 10 to discharge should either the safety of the weapon not be on, or the swing out safety block 62 be in an active position when the slotted cam plate 44 was displaced. While the applicant has disclosed the use of a frictional type safety lock utilizing a wedge 42 that frictionally engages the slide tube 36, it is possible to have a positive type (not shown) locking mechanism which would prohibit the displacement of the cam plate 44 by use of slots or notches positioned on either the slide tube 36 or slotted cam plate 44.

Applicant having explained in detail how the invention is made and used would now like to explain the steps in converting any semi-automatic weapon 10, such as a Charter Arms AR-7 into a weapon having the firing capacity of nearly an automatic weapon.

First, remove the weapons stock (not shown) by removing the weapons shoulder bolts, pins or screws which hold the stock to the receiver 11 and barrel 12 of the weapon. Next place the gun barrel 12 of the semi-automatic weapon 10 through barrel clamp 39 aperture and align the main side plate 30 aperture so that the mounting screw 21 of the Rapid Fire Trigger Activator 20 may be secured to the weapons' 10 receiver 11. For those weapons 10 having only a one piece stock the gun stock assembly 70 portion of the Rapid Fire Trigger Activator 20 is secured to the end of the receiver 11 by means of grip screws 73 disposed through an aperture within the pistol grip 72. Weapons having a two piece stock the attachment of a pistol grip 72 and shoulder 74 stock is not necessary, therefore, the gun stock assembly 70 is detached from the Rapid Fire Trigger Activator 20 by means of machine screws 75. Once the gun stock assembly 70 is secured to the weapon the barrel clamp 39 is secured to the semi-automatic weapon 10 gun barrel 12 by tightening machine screw 40 and the weapon is now readily to fire in either a semi-automatic or rapid fire mode.

If the user desires to operate the weapon in a semi-automatic mode he need only place the swing 65 of the swing out safety block 62 in an inactive position, as shown in FIG. 7 of the drawings. However, should the user desire to operate the semi-automatic weapon 10 in the raid fire mode the swing 65 of the swing out safety block 62 would be placed in the active position, as seen in FIG. 1 of the drawings and the safety wedge 42 of the fore end hand grip 41 would be deactivated so that the fore end hand grip 41 may be displaced in a horizontal pumping action back and forth along the slide tube 36. It can be appreciated that once my Rapid Fire Trigger Activator 20 is connected to a semi-automatic weapon 10 the trigger 13 of the weapon 10 is fully accessible and operable at all times, regardless of the position of the swing out safety block 62. Thus, allowing the user of the weapon to operate it in the conventional way, whether shooting from the hip or shoulder, without the weapon loosing its semi-automatic firing capability, thus making it far superior to other prior art embodiments.

Applicant having described the preferred embodiment of his invention now wishes to disclose, as best seen in FIGS. 9 to 16 a second embodiment of the invention which can be directly attached to the receiver of any semi-automatic weapon 10, such as Ruger TM 10-22.

Figure 9:
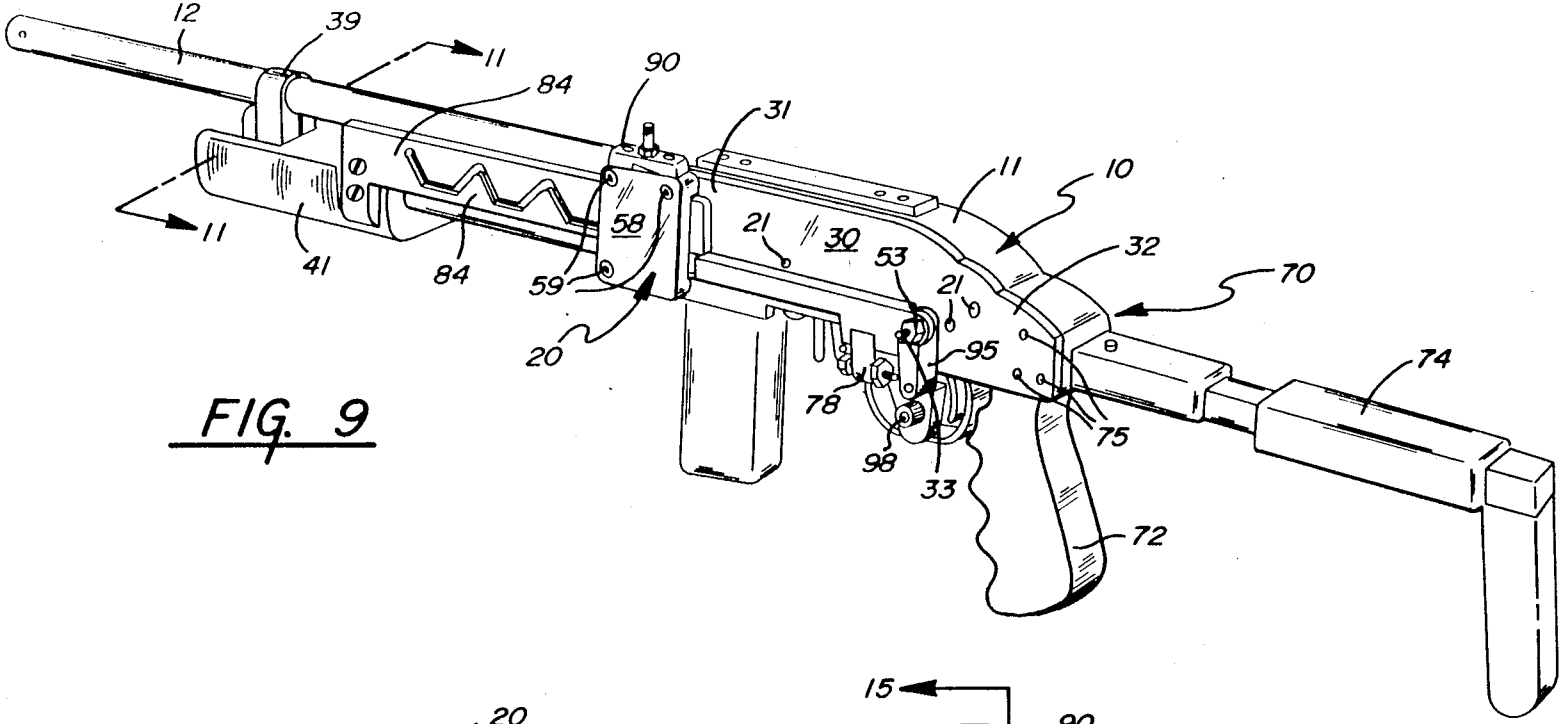
FIG. 9 is a perspective view of my Rapid Fire Trigger Activator and gun stock accessory attached to a semi-automatic weapon where in the slotted cam plate is visible to the user.

The Rapid Fire Trigger Activator 20 is generally designated by reference numeral 20, as shown, is attached to a semi-automatic weapon 10 of a one stock (not shown) construction. While the operation of my Rapid Fire Trigger Activator 20 is the identical to the above already explained preferred embodiment there are some difference between a Charter Arms AR-7 and Ruger TM 10-22 construction and operation which has resulted in differences in the main side plate 30, slotted cam plate 44 and swing out safety block 62 construction. As can be seen in FIG. 9, which is a perspective view of a Rapid Fire Trigger Activator 20 and accessory gun stock 70 is shown attached to a semi-automatic weapon 10, that the slotted cam plate (outside) 84 cam recess 85 is visible and is facing out from the main side plate 30. Further, the Ruger TM 10-22 construction (semi-automatic weapon) does not require the use of a horizontal spacer 34 or vertical spacer to clear the receiver 11 and therefore is not used in this embodiment.

The main side plate 30 is attached directly to the semi-automatic weapon 10 by mounting screws 21 which has replaced the weapons three receiver pins. The slide tube 36 is attached to one end of the main side plate 30 by means of an anchor block (not shown) and machine screws (not shown) and is secured to both the semi-automatic weapon 10 gun barrel 12 by means of barrel clamp 39 and the receiver 11 by means of a machine screw (not shown) through anchor block (not shown) in a spacious and parallel relationship. The main side plate 30 has a fore end 31 and rear portions 32 with a pivot pin 33 disposed at its rear portion 32. A transfer bar 50 having an aperture 51 at one end and a cam follower slot pin 52 at the opposite end is disposed unto the pivot pin 33 of the main side plate 30 through aperture 51 over the trigger activator 95. The transfer bar 50 is pivotly secured to the pivot pin 33 on the main side plate 30 by means of nut 53 and washer 54. Near the aperture 51 end of the transfer bar 50 is a swing out safety block 78 which is pivotly connected to the transfer bar 50 having a plunger pin 79. Unlike the previous disclosed embodiment the plunger pin 79 requires no spring since the Ruger TM 10-22 trigger does not have to more for the sear of the weapon to lock back up after discharge, due to the difference in the weapons action.

Figure 14:
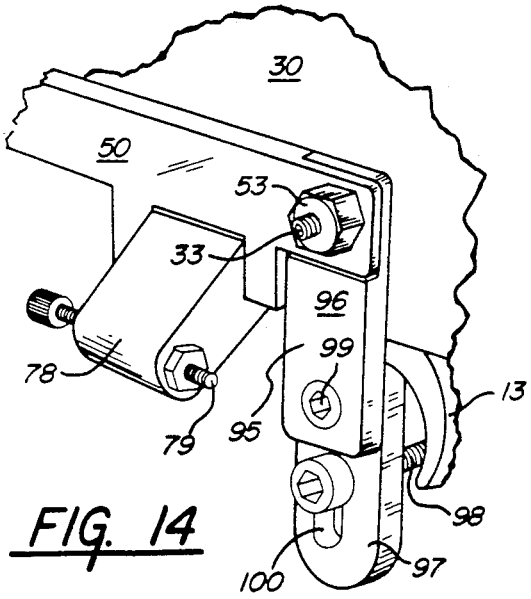
FIG. 14 is an enlarged perspective view of the swing out safety block and trigger activator as it would appear next to a weapon's trigger.

As can be best seen in FIG. 14 of the drawings the trigger activator 95 has an upper 96 and lower 97 segments which allow for the pivoting of the lower 97 segment to fine adjust the location of the activator 95 trigger pin 98 to the shape of the trigger 13 of a semi-automatic weapon 10 by loosening and tightening of the lock screw 99. The trigger activator 95 has a slot 100 which allows the vertical movement of the trigger pin 98 for fine adjustment of the trigger activator 95 to conform to different trigger 13 shapes. The trigger activator 95 must be able to move and operate separately from the transfer bar 50, otherwise the trigger 13 of the semi-automatic weapon 10 could not be operated in semi-automatic mode.

Figure 10:
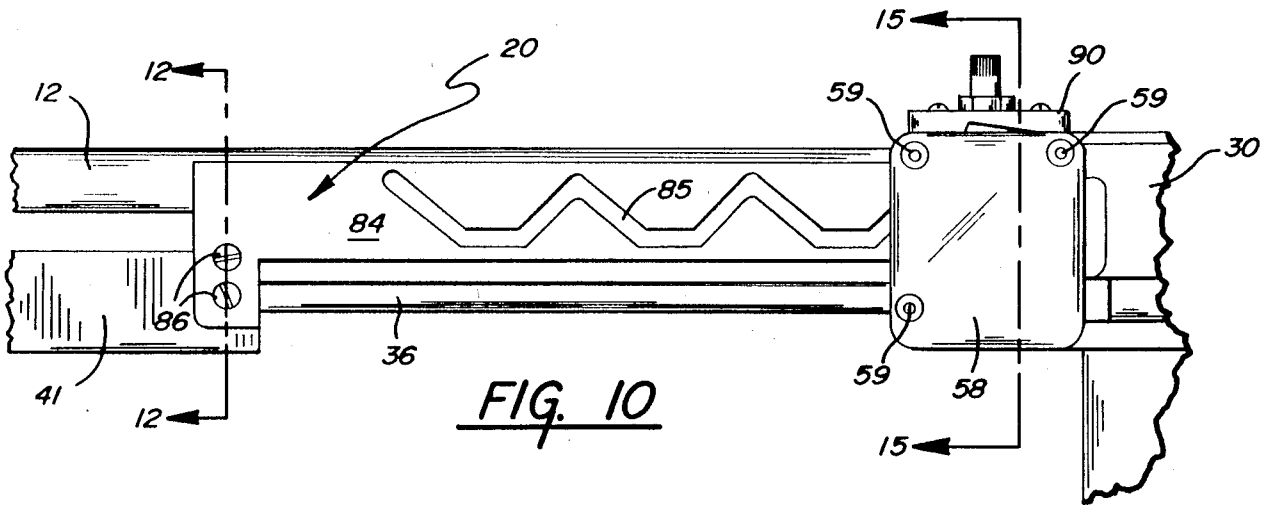
FIG. 10 is an enlarged partial elevational view of my invention showing the flat cam of the slotted cam plate.
Figure 16:
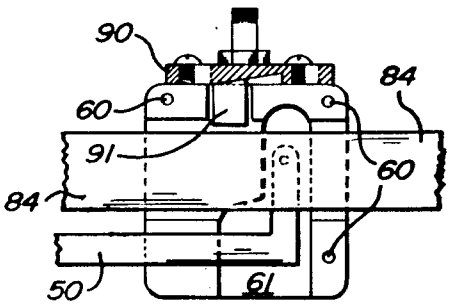
FIG. 16 is a cross sectional view along line 16—16 of FIG. 15 in the direction of the arrows showing the inside surface of the nylon bearing block in relation to the slotted cam plate and transfer bar.

Referring now to FIG. 10 of the drawings which is an enlarged partial elevational view of my invention the slotted cam plate (outside) is shown attached to the fore end hand grip 41 by means of machine screws 86. The fore end hand grip 41 like the previous embodiment is mounted over the slide tube 36 so as to allow for its back and forth longitudinal movement. With the fore end hand grip 41 in position the cam follower slot pin 52 of the transfer bar 50 is disposed into the cam recess 85 of the slotted cam plate (outside) 84 and nylon bearing block 58 is attached to the main side plate 30 by machine screws 59 through apertures 60 to effectively hold the completed Rapid Fire Trigger Activator 20 apparatus together. As in the earlier disclosed embodiment the nylon bearing block 58 provides a bearing surface for the operation of the transfer bar 50 and slotted cam plate 84. Further, as can be best seen in FIG. 16 of the drawings showing the inside surface of the nylon bearing block 58, it has a recess 61 which allows for a both horizontal movement of the slotted cam plate 84 and the vertical movement of the transfer bar 50 during its operation.

Attached to the rear portion 32 of the main side plate 30 is the gun stock accessory 70 having a pistol grip 72 and adjustable shoulder stock 74 which are affixed to the main side plate 30 by machine screws 75. On semi-automatic weapons 10 having a two piece stock both the pistol grip 72 and adjustable shoulder stock 74 would be eliminated from my Rapid Fire Trigger Activator 20.

Figure 13:
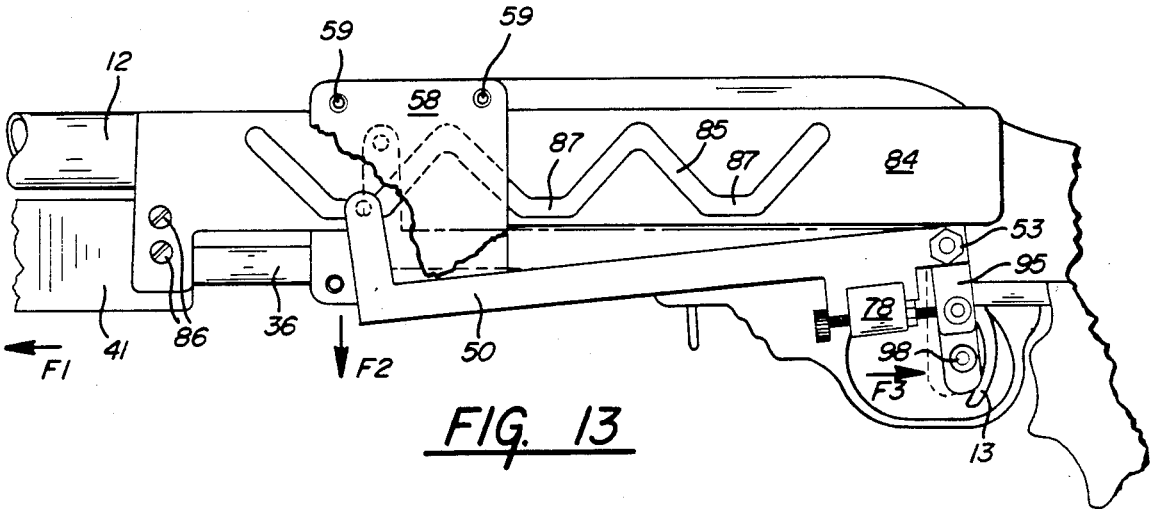
FIG. 13 is an enlarged partial elevational view of my invention depicting the movement of the transfer bar, swing out safety block and trigger activator.

Referring to FIG. 13 of the drawings which is an enlarged partial elevational view of my invention depicting how the Rapid Fire Trigger Activator 20 causes the displacement of the trigger 13 of the semi-automatic weapon 10. As the fore end hand grip 41 moves in the F-1 direction along slide tube 36 it pulls the slotted cam plate (outside) 84 in the same direction which in turn causes vertical displacement in the F-2 direction of the cam follower slot pin 52 of the transfer bar 50 which rotates at the opposite end about pivot pin 33 which in turn causes the swing out safety block 78 plunger pin 79 to displace the trigger activator 95 trigger pin 98 in the F-3 horizontal direction which in turn causes the displacement of trigger 13 of the semi-automatic weapon 10. Applicant has found that the use of a cam recess 85 having a flat section 87 provides a short dwell, giving the trigger 13 additional time to recycle before the next shot. This enhancement of the trigger 13 operation while having no effect on the weapons firing speed, does reduce the number of available shots per stroke from four to three due to the additional space required for the flat section 87 of the cam recess 85.

Figure 11:
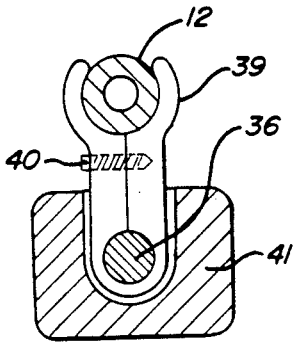
FIG. 11 is a cross section view taken along line 11—11 of FIG. 9 in the direction of the arrows showing the end of the fore end hand grip.
Figure 12:
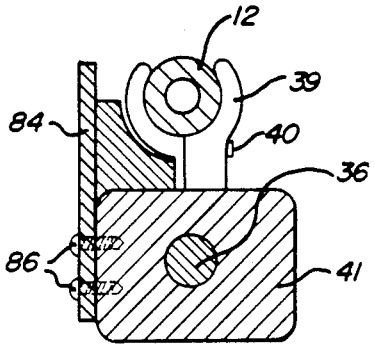
FIG. 12 is a cross section view along line 12—12 of FIG. 10 taken in the direction of the arrows showing the connection of the slotted cam plate (outside) and fore end hand grip.

Referring to FIGS. 11 and 12 of the drawings it is readily apparent that the fore end had grip 41 is not in any way restricted from movement along the slide tube 36 since unlike the earlier embodiment there is no safety wedge which services to frictionally secure it.

Figure 15:
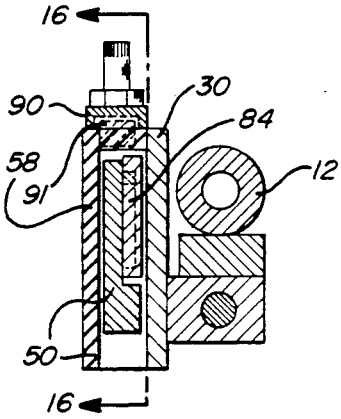
FIG. 15 is a cross section view along line 15—15 of FIG. 10 in the direction of the arrows showing the main side plate, slotted cam plate, transfer bar and nylon bearing block.

Applicant wishes to disclose the use of a frictional type safety lock mechanism which operates on the slotted cam plate (outside) 84 as can be best seen ihn FIG. 15 of the drawings. There is a moveable switch 90 located on top of the nylon bearing block 58 which when moved in the direction of the end of the gun barrel 12 causes the vertical displacement of safety wedge 91 to be in tight frictional contact with the top of slotted cam plate (outside) 84 so as to prohibit its horizontal movement. As in the earlier embodiment applicant wishes to disclose the use of a positive type (not shown) locking mechanism with slots or notches to lock the slotted cam plate 84 in place. While applicant has disclosed the use of a safety locking mechanism associated with the slotted cam plate 84 additional types of safety locks are possible, such as the use of a safety wedge 42 in combination with the fore end hand grip 41, said additional safety locks may be used alone or together with the slotted cam plate 84 safety lock.

The steps associated with converting a semi-automatic weapon 10, such as a Ruger TM 10-22 into a rapid fire weapon utilizing my invention includes the removal of the weapons stock mounting pins and screws. Next the gun barrel 12 of the semi-automatic weapon 10 is inserted through the barrel clamp 39 aperture and the main side plate 30 apertures are lined up with three shoulder bolts projecting through the weapons 10 receiver 11 into the Rapid Fire Trigger Activator 20 and all shoulder bolts are tightened. Once all shoulder bolts are in place the barrel clamp 39 is tightened by means of machine screw 40.

The firing operation of my Rapid Fire Trigger Activator 20 is identical for both the Ruger TM 10-22 and Charter Arms AR-7. Both embodiments use a slotted cam plate of the same length with the trigger activator 55 and 95 mechanism working in both directions of the fore end hand grip 41 stroke as the semi-automatic weapon 10 firing cycle of recoil-eject-reload-fire occurs for each pull (push) of the trigger 13. While applicant has disclosed two embodiments of his invention it is important to recognize that it may be necessary to change somewhat the invention to physically connect it to a semi-automatic weapon 10 having different mounting holes and shapes. While applicant has disclosed the use of swing out safety block 78 having no spring load plunger pin 79 because the Ruger TM 10-22 trigger does not have to move since its sear locks up under spring, it is recommended that a spring loaded plunger pin 64 be used as a safety feature to prevent the inadverted discharge of the weapon should the trigger be inadvertently hit.

Thus, by abandoning the previous construction of rapid fire devices which prohibits the use of a semi-automatic weapon in a conventional manner, I have invented a Rapid Fire Trigger Activator which allows either the semi-automatic or rapid fire operation of any semi-automatic weapon which is simple, practical, economical and attractive in appearance.

I claim:

1. A rapid fire trigger activator apparatus attached to a weapon's receiver used to convert any semi-automatic firearm, fired from the shoulder, into nearly the firing capability of an automatic weapon, comprising:

a main side plate being suitably attached to the receiver of the semi-automatic weapon, said main side plate having a fore end, rear, and top portions with a pivot pin located near its rear portion;

a fore end slide tube, said slide tube being suitably mounted at one end to the fore end portion of said main side plate and to the semi-automatic weapon's gun barrel at the opposite end;

a trigger activator having a trigger pin being disposed over the pivot pin of said main slide plate;

a transfer bar having an aperture at one end and a cam follower slot pin at the opposite end, said transfer bar being disposed unto the pivot pin of said main side plate through the aperture over said trigger activator;

a slotted cam plate having a cam recess into which the cam follower slot pin of said transfer bar is disposed, said slotted cam plate having a fore end portion;

a bearing block, said bearing block being suitably attached to the fore end portion of said main side plate so as to form a bearing surface for said slotted cam plate and said transfer bar;

a fore end hand grip, said fore end hand grip being suitably connected to the fore end portion of said slotted cam plate and mounted over said slide tube so as to allow it to move in a longitudinal back and forth direction,, with reference to the semi-automatic weapon's gun barrel, along side slide tube; and a swing out safety block being suitably attached to said transfer bar near its aperture, whereby the longitudinal movement of the fore end hand grip in a pumping back and forth action will cause the semi-automatic weapon to fire at nearly the firing capability of an automatic weapon.

2. A rapid fire trigger activator, as defined in claim 1, further comprising:

a horizontal spacer having a stem at its top, said horizontal spacer being suitably attached to the top portion of said main slide plate; and a vertical spacer, said vertical spacer being suitably attached to the fore end portion of said main side plate;

whereby the horizontal and vertical spacer provides the necessary clearance of the semi-automatic weapons receiver for the back and forth longitudinal movement of the slotted cam plate.

3. A rapid fire trigger activator, as defined in claim 2, wherein said slotted cam plate rescess is facing in towards said main side plate.

4. A rapid fire trigger activator, as defined in claim 1, wherein said slotted cam plate recess is facing out from said main side plate.

5. A rapid fire trigger activator; as defined in claim 3, wherein said swing out safety block has a swing pivotly connected thereto with a spring loaded plunger pin disposed within the swing.

6. A rapid fire trigger activator, as defined in claim 4, wherein said swing out safety block has a swing pivotly connected thereto with a plunger pin.

7. A rapid fire trigger activator, as defined in claim 5, wherein said fore end hand grip has a frictional wedge type mechanism disposed therein which securely locks said fore end hand grip in any position along said slide tube.

8. A rapid fire trigger activator, as defined in claim 7, wherein said trigger activator has a slot therein to allow the vertical movement of the trigger pin to allow for fine adjustment to accommodate different semi-automatic weapons trigger shapes.

9. A rapid fire trigger activator, as defined in claim 8, wherein the cam recess of said slotted cam plate is V-shaped with three to four used per length of forward or backward stroke of said fore end hand grip.

10. A rapid fire trigger activator, as defined in claim 9, wherein said bearing block has a frictional type safety lock mechanism which can prohibit the horizontal movement of said slotted cam plate.

11. A rapid fire trigger activator, as defined in claim 10, further comprising:

a gun stock assembly having a pistol grip and adjustable shoulder stock; said gun stock assembly being suitably mounted to said main side plate and to the semi-automatic weapon's receiver.

12. A rapid fire trigger activator, as defined in claim 2, further comprising:

a gun stock assembly having a pistol grip and adjustable shoulder stock, said gun stock assembly being suitably mounted to said main side plate and to the semi-automatic weapon's receiver.

13. A rapid fire trigger activator, as defined in claim 6, wherein said bearing block has a frictional type safety lock mechanism which can prohibit the horizontal movement of said slotted cam plate.

14. A rapid fire trigger activator, as defined in claim 13, wherein said trigger activator has an upper and lower segment pivotly connected to said main slide plate, the lower segment has a slot therein to allow a vertical movement of the trigger pin to allow for fine adjustment, a combination of the pivoting lower section and vertical movement of the trigger pin accommodates the different semi-automatic weapons trigger shapes.

15. A rapid fire trigger activator, as defined in claim 14, wherein the cam recess of said slotted cam plate has a flat section with three to four used per length of forward or backward stroke of said fore end hand grip.

16. A rapid fire trigger activator, as defined in claim 15, wherein said fore end hand grip has a frictional wedge type mechanism disposed therein, which securely locks said fore end had grip in any position along said slide tube.

17. A rapid fire trigger activator, as defined in claim 16, further comprising:

a gun stock assembly having a pistol grip and adjustable shoulder stock, said gun stock assembly being suitably mounted to said main side plate and to the semi-automatic weapon's receiver.

18. A rapid fire trigger activator, as defined in claim 4, further comprising:

a gun stock assembly having a pistol grip and adjustable shoulder stock, said gun stock assembly being suitably mounted to said main side plate and to the semi-automatic weapon's receiver.

19. A rapid fire trigger activator used to convert a Charter Arm AR-7 weapon from a semi-automatic into nearly the firing capability of an automatic weapon, comprising:

a main side plate being suitably attached to the receiver of the semi-automatic weapon, said main side plate having a fore end, rear and top portions with a pivot pin located near its rear portion, a horizontal spacer being attached to its top portion and a vertical spacer to its fore end portion.

a fore end slide tube, said slide tube being suitably mounted at one end to the fore end portion of said main side plate and to the semi-automatic weapon's gun barrel at the opposite end;

a trigger activator having a trigger pin being disposed over the pivot pin of said main slide plate;

a transfer bar having an aperture at one end and a cam follower slot pin at the opposite end, said transfer bar being disposed unto the pivot pin of said main side plate through the aperture over said trigger activator;

a slotted cam plate having a cam recess into which the cam follower slot pin of said transfer bar is disposed, said slotted cam plate having a fore end portion;

a bearing block, said bearing block being suitably attached to the fore end portion of said main side plate so as to form a bearing surface for said slotted cam plate and transfer bar;

a fore end hand grip, said fore end hand grip being suitably connected to the fore end portion of said slotted cam plate and mounted over said slide tube so as to allow it to move in a longitudinal back and forth direction, with reference to the semi-automatic weapon's gun barrel, along said slide tube;

a swing out safety block being suitably attached to said transfer bar near its aperture; and a gun stock assembly having a pistol grip and adjustable shoulder stock, said gun stock assembly being suitably mounted to said main side plate and to the semi-automatic weapon's receiver;

whereby the longitudinal movement of the fore end hand grip in a pumping back and forth action will cause the semi-automatic weapon to fire at nearly the firing capability of an automatic weapon.

20. A rapidl fire trigger activator used to convert a Ruger TM 10-22 weapon from a semi-automatic into a nearly the firing capability of an automatic weapon, comprising:

a main side plate being suitably attached to the receiver of the semi-automatic weapon, said main side plate having a fore end and rear portions with a pivot pin located near its rear portion;

a fore end slide tube said slide tube being suitably mounted at one end to the fore end portion of said main side plate and to the semi-automatic weapon's gun barrel at the opposite end;

a trigger activator having a trigger pin being disposed over the pivot pin of said main slide plate;

a transfer bar having an aperture at one end and a cam follower slot pin at the opposite end, said transfer bar being disposed unto the pivot pin of said main side plate through the aperture over said trigger activator;

a slotted cam plate having a cam recess into which the cam follower slot pin of said transfer bar is disposed, said slotted cam plate having a fore end portion;

a bearing block, said bearing block being suitably attached to the fore end portion of said main side plate so as to form a bearing surface for said slotted cam plate and transfer bar;

a fore end hand grip, said fore end hand grip being suitably connected to the fore end portion of said slotted cam plate and mounted over said slide tube so as to allow it to move in a longitudinal back and forth direction, with reference to the semi-automatic weapon's gun barrel, along said slide tube;

a swing out safety block being suitably attached to said transfer bar near its aperture; and a gun stock assembly having a pistol grip and adjustable shoulder stock, said gun stock assembly being suitably mounted to said main side plate and to the semi-automatic weapon's receiver;

whereby the longitudinal movement of the fore end hand grip in a pumping back and forth action will cause the semi-automatic weapon to fire at nearly the firing capability of an automatic weapon.

* * * * *